US006547079B2

(12) United States Patent
Sardo

(10) Patent No.: US 6,547,079 B2
(45) Date of Patent: Apr. 15, 2003

(54) MACHINE FOR THE SORTING BY SIZE OF PEAR-SHAPED OBJECTS

(75) Inventor: Stefano Sardo, Chateaurenard (FR)

(73) Assignee: Xeda International, Saint-Andiol (FR)

( * ) Notice: Subject to any disclaimer, the term of this patent is extended or adjusted under 35 U.S.C. 154(b) by 0 days.

(21) Appl. No.: 09/758,217

(22) Filed: Jan. 12, 2001

(65) Prior Publication Data

US 2001/0037961 A1 Nov. 8, 2001

(30) Foreign Application Priority Data

Jan. 14, 2000 (FR) ..... 00 00481

(51) Int. Cl.[7] ..... B07C 5/06
(52) U.S. Cl. ..... 209/626; 209/676; 209/911
(58) Field of Search ..... 209/621, 622, 209/623, 624, 626, 627, 911, 922, 675, 676

(56) References Cited

U.S. PATENT DOCUMENTS 1,242,573 A * 10/1917 Matson ..... 209/623
1,337,257 A 4/1920 O'Quinn ..... 209/622
1,846,327 A * 2/1932 Gray ..... 209/626
5,998,754 A 12/1999 Pervieux ..... 209/923 X

FOREIGN PATENT DOCUMENTS

| | | |
|---|---|---|
| FR | 1 105 584 | 12/1955 |
| FR | 1 480 308 | 7/1967 |
| FR | 2 323 460 | 4/1977 |
| FR | 2 473 364 | 7/1981 |

* cited by examiner

*Primary Examiner*—Tuan N. Nguyen
(74) *Attorney, Agent, or Firm*—Wenderoth, Lind & Ponack, L.L.P.

(57) ABSTRACT

A machine for the sorting by size of pear-shaped objects including a conveyor (10) able to move essentially horizontally. The conveyor includes a first alignment of equidistant and parallel primary rollers (30) separated each from the next by an interval allowing one object to pass through. The conveyor (10) also has a second alignment of secondary rollers (44) each arranged in alignment with an interval. The machine has a device (42) for guiding the secondary rollers (44) along a sorting path (14) of the conveyor. The guide device (42) being such as to move the secondary rollers progressively away from the primary rollers along the length of the sorting path (14). The primary and secondary rollers do not rotate about their axis for the greater part of the sorting path (14).

16 Claims, 3 Drawing Sheets

MACHINE FOR THE SORTING BY SIZE OF PEAR-SHAPED OBJECTS

BACKGROUND OF THE INVENTION

1. Field of the Invention

The present invention relates to a machine for the sorting by size of pear-shaped objects of the type comprising a conveyor, which is able to move essentially horizontally. The conveyor has a first alignment of equidistant parallel primary rollers separated each from the next by an interval allowing one object to pass through. The conveyor also has a second alignment of secondary rollers each arranged in alignment with an interval, which secondary rollers are able to move perpendicular to the plane of travel of the primary rollers. The machine has means to guide the secondary rollers along a sorting path of the conveyor, and the guide means being such as to progressively move the secondary rollers away from the primary rollers along the length of the sorting path.

2. Description of Related Art

Such a machine is disclosed for example in Patent Application FR-A-2 473 364. In that machine all of the primary and secondary rollers are rotated about their parallel axes.

Machines of the above type are used particularly for sorting generally spherical fruit or vegetables such as apples and oranges according to size.

The machine is not however suitable for pear-shaped fruit or vegetables, that is fruit or vegetables having the general shape of an oval with a more or less narrow end. Examples of fruits having this shape are pears, avocados and courgettes.

What is found is that the rotation of the rollers causes the objects being sorted to rotate themselves. The effect of the rotation, when applied to oval objects with a narrow end, is that the objects are caused to work their way towards one or other of the ends of the rollers. This migration of the objects along the length of the rollers injures them and crushes them, thereby impeding the normal operation of the machine.

SUMMARY OF THE INVENTION

It is an object of the invention to provide a machine for the sorting by size of pear-shaped objects that does not have the drawbacks mentioned above and which in particular prevents the transverse displacement of the objects during the sorting process.

To this end the subject of the invention is a machine for the sorting by size of pear-shaped objects, of the aforementioned type, characterized in that the primary and secondary rollers do not rotate about their axis for the greater part of the sorting path.

In accordance with certain particular embodiments, the machine has one or more of the following characteristics:

(1) the machine has means for positioning the objects with their longitudinal axis essentially parallel to the primary and secondary rollers;

(2) the positioning means comprise an auxiliary roller feeder whose rollers are rotated slowly about themselves and means of transfer from the auxiliary feeder to the conveyor with little or no modification to the orientation of the objects;

(3) the positioning means are built into the conveyor, the conveyor comprising, upstream of the sorting path, an object receiving section, along the length of which the primary and secondary rollers are rotated slowly about themselves in order to position the objects; and (4) the machine comprises a plurality of elastically deformable adjacent revolving rollers located immediately beneath the sorting path in order to soften the fall of the objects.

BRIEF DESCRIPTION OF THE DRAWINGS

A clearer understanding of the invention will be gained from reading the following description, which is provided purely by way of example and refers to the drawings in which.

DETAILED DESCRIPTION OF THE INVENTION

Figure 1:
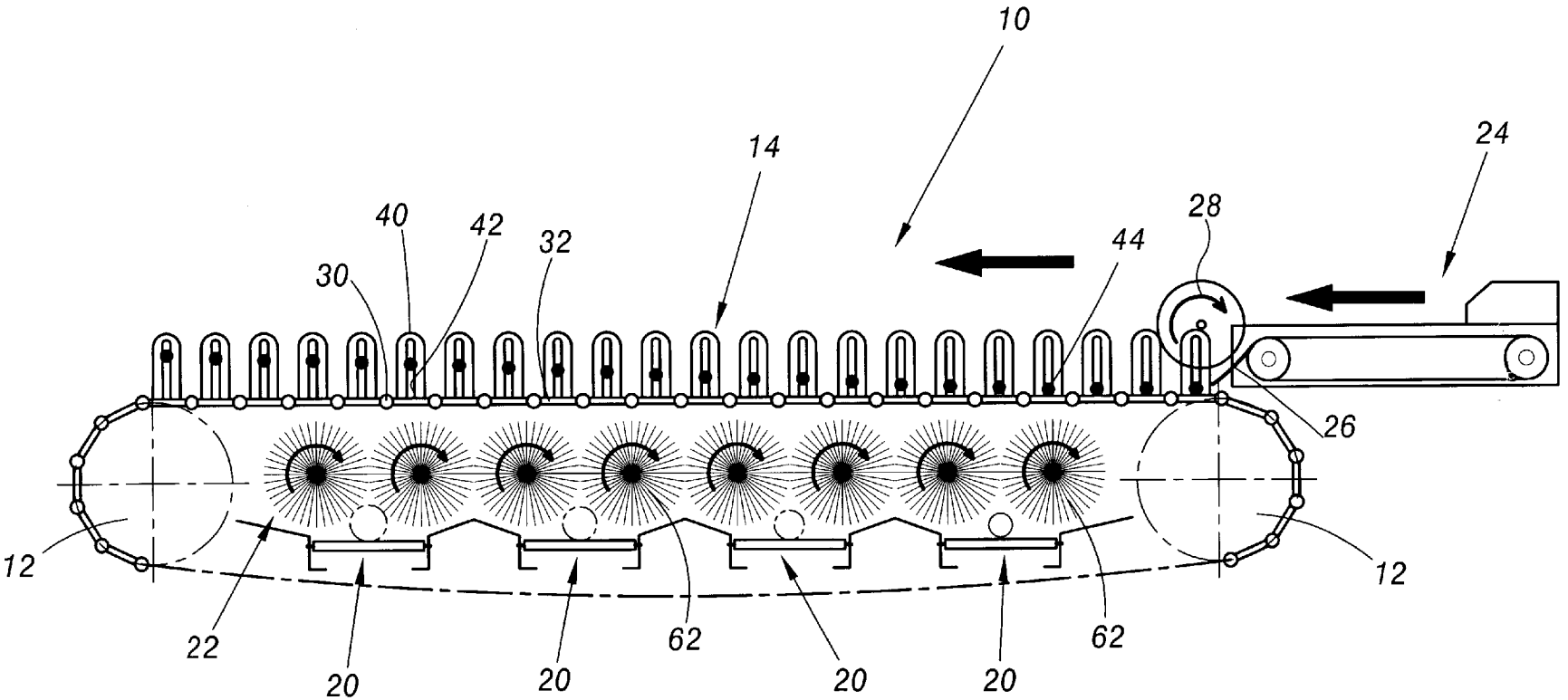
FIG. 1 is a side view of the sorting machine according to the present invention.

The machine according to the invention is shown in FIG. 1. It is designed to sort pears on the basis of their size.

The machine comprises a roller conveyor 10 forming an endless loop and travelling between two terminal drums 12, one of which is a drive drum. Along an upper side, the conveyor 10 defines a known sorting path 14. Along its other side the conveyor defines a return path.

Between the two sides of the conveyor are four endless feeders 20 for conveying the fruit towards the packaging centers. Each endless feeder 20 is associated with fruit of one particular size. These feeders extend horizontally and at right angles to the conveyor 10. Between the feeders 20 and the upper side of the conveyor 10 are means 22 for receiving the sorted fruit by softening their fall as they come off the conveyor 10.

The machine also comprises an auxiliary endless feeder 24 that supplies-the fruit to be sorted. This feeder is advantageously a roller feeder that supplies the fruit to the entrance of the sorting path 14, the pieces of fruit being separated by a predetermined constant interval. The feeder 24 has rollers turning upon themselves at slow speeds, for example at a speed of 100 rpm for a conveyor having a linear-speed of 20 m/min.

The auxiliary feeder 24 is particularly suitable for ensuring that the pieces of fruit arrive on the sorting path 14 with their longitudinal axes parallel to the plane of movement of the conveyor 10 on the sorting path and perpendicular to the direction of advance of the conveyor. The pieces of fruit therefore reach the sorting path with their axes parallel to the rollers of the conveyor 10.

In addition, the machine comprises, between the auxiliary feeder 24 and the sorting path 14, a ramp 26 and a presser roller 28 that accompanies the descent of the fruit from the feeder 24 to the entrance of the sorting path 14, without the orientation of the axis of the fruit being modified.

Figure 2:
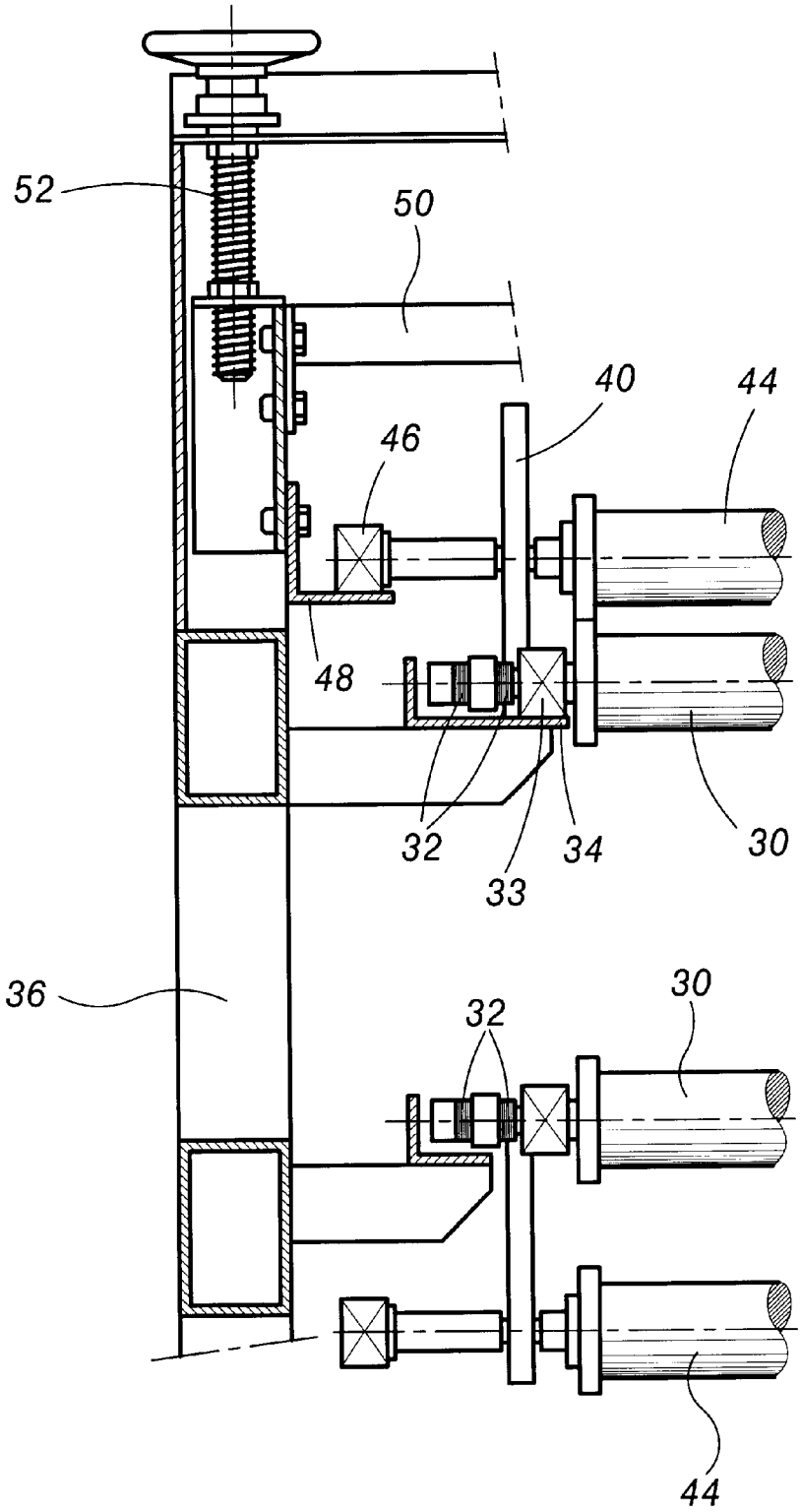
FIG. 2 is a partial view in cross section of the sorting machine according to the present invention.
Figure 3:
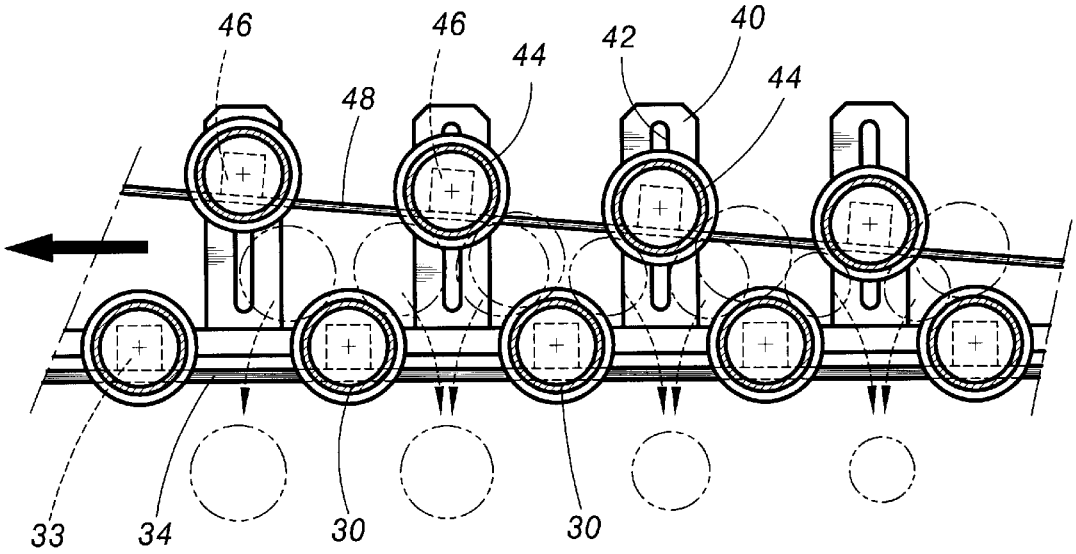
FIGS. 3 and 4 are partial cross sections taken in the direction of the length of the upper side and lower side of the composite conveyor of the machine.

As illustrated in FIGS. 2 and 3, the conveyor 10 is equipped with an alignment of primary rollers 30 extending parallel to each other. These rollers are arranged essentially horizontally and perpendicular to the direction of advance of the conveyor on the sorting path 14. They are equidistant and define intervals through which the largest size of fruit to be sorted can pass. The primary rollers 30 are carried at their ends by endless chains 32 between the terminal drums 12.

At each end, the rollers 30 have, on their spindles, shoes 33 with at least one flat.

Along the horizontal path forming the sorting path 14, the shoes 33 rest on horizontal sliding tracks 34 mounted on either side of the conveyor 10 on a machine frame 36.

The rollers 30 are preferably covered with an elastic and flexible material, and at their ends have annular enlargements that exert a retaining action on the fruit to be sorted.

In the intermediate part of each segment of the chain 32, which lies between two consecutive rollers 30, that is to say in alignment with the intervals separating two rollers, a plate 40 is attached to the chain. This plate extends at right angles to the plane of the rollers, that is vertically above the sorting path 14. The plate 40 contains a slot 42 that extends at right angles to the plane of the rollers. These slots act as guides for a second alignment of rollers 44, termed the secondary rollers, which are driven by the chains 32. This guidance takes place in a direction at right angles to the direction of travel of the primary rollers 30.

The slots 42 take the ends of the spindles of the rollers 44, these rollers being identical to the rollers 30. In this way the rollers 44 lie and travel parallel to the rollers 30.

On the ends of the spindles of the rollers 44, beyond the plates 40, are shoes 46 resting on guide ramps 48. These shoes 46 include at least one flat.

The guide ramps 48 are carried by a moveable gantry 50 whose slope is adjustable relative to the frame 36 by screw-and-nut adjustment means 52.

The ramps 48 are inclined relative to the horizontal, and in particular relative to the sorting path 14 defined by the sliding surfaces. The surface on which the shoes 46 rest rises progressively along the sorting path.

On the sorting path 14, the rollers 30 and 44 are unable to rotate about their axis relative to the chains 32. Their only movement is therefore that of translation imparted by the chains. The non-rotation of the rollers is obtained by the shoes 33 and 46, each with a flat that rests on the tracks 34 and 46.

The non-rotation of the rollers 30 and 44 means in the particular context that the rollers are not intentionally rotated by any mechanism of the machine. However, they can be mounted idly, in which case they are mechanically independent of the machine's drive systems.

The means 22 that receive the pieces of fruit take the form of revolving brushes 62 lined up beneath the sorting path and extending parallel to each other. The brushes 62 are tangential to each other and are rotated in the same direction.

It will be realized that, as the primary rollers 30 and secondary rollers 44 travel along the upper side of the conveyor defining the sorting path 14, the secondary rollers, though initially lying virtually on the same level as the primary rollers, progressively move away from these. As a result, each piece of fruit introduced from the feeder 24 initially rests on a primary cylinder and on a secondary cylinder. As it travels along the sorting path 14, the gap between the primary and secondary rollers eventually becomes great enough for the fruit to drop through between two primary rollers, whereupon it is received on the brushes 62 situated underneath. These brushes then accompany the fruit as it drops onto the feeder 20 where all fruit of the same size is received.

It can be seen that as the primary and secondary rollers are not rotated, the pear-shaped fruit can be sorted satisfactorily and without the danger of being crushed.

Furthermore, the presence of the revolving brushes 62 forming elastically deformable adjacent revolving rollers softens the fall of the fruit and saves it from being spoiled by sudden impacts.

In particular, in the case of pears, the perforations caused by the stem of one pear penetrating another pear are averted.

In one particular embodiment, the upper side of the feeder has two consecutive sections. On the first section forming a fruit receiving section, the primary and secondary rollers are rotated slowly to allow correct positioning of the fruit with its axis parallel to the rollers. On this section, roller rotating means of any suitable type are employed. The speed of rotation of the rollers is approximately 100 rpm for a linear speed of advance of the conveyor of approximately 20 m/min.

On the receiving section, the gap between the primary and secondary rollers is minimal and constant.

The receiving section is followed by a sorting section analogous to the sorting path described above. On this sorting section, the primary and secondary rollers do not rotate about their axis and the secondary rollers move progressively away from the primary rollers as they advance.

Figure 4:
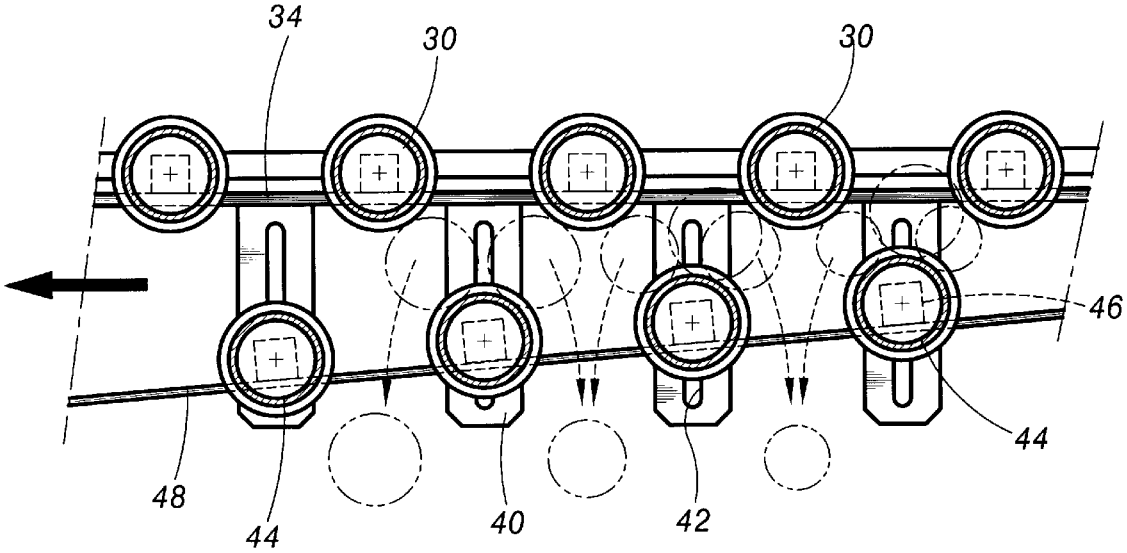

Referring to FIG. 4, it can be seen that providing guides also on the lower side of the conveyor to support the shoes 33 and 46 with which the rollers 30 and 44, respectively, are equipped, and by constructing the rest as described above in respect of the upper side of the conveyor, it is also possible to use the lower side of the conveyor for sizing the fruit. By adding a small number of other parts, the already high productivity of the machine can therefore be doubled, with the obvious advantages resulting from this possibility.

What is claimed is:

1. A machine for sorting, by size, pear-shaped objects having the general shape of an oval with a more or less narrow end, said machine comprising:

a conveyor capable of moving essentially horizontally and having a first alignment of equidistant parallel primary rollers separated each from the other by an interval sufficient to allow one object to pass through, the conveyor also having a second alignment of secondary rollers each arranged in alignment with an interval between adjacent ones of said primary rollers, said secondary rollers being capable of moving in a direction that is perpendicular to a plane of travel of said primary rollers;

means for conveying the primary and secondary rollers along a sorting path of said conveyor;

means for guiding said secondary rollers along the sorting path of said conveyor, said guide means being operable to progressively move said secondary rollers away from said primary rollers along the length of the sorting path, wherein said primary and secondary rollers do not rotate about their axes over a greater part of the sorting path; and means for positioning the objects with their longitudinal axes essentially parallel to said primary and secondary rollers, said means for positioning the objects being located upstream of the sorting path.

2. The machine as claimed in claim 1, wherein said positioning means comprises an auxiliary feeder having a plurality of rollers that can be rotated slowly about themselves and means for transferring the objects from the said auxiliary feeder to said conveyor with little or no modification of the orientation of the objects.

3. The machine as claimed in claim 2, further comprising a plurality of elastically deformable adjacent revolving rollers located immediately beneath the sorting path in order to soften the fall of the objects.

4. The machine as claimed in claim 1, wherein said positioning means is built into said conveyor, and said conveyor comprises, upstream of the sorting path, an object receiving section, along the length of which said primary and secondary rollers can be rotated slowly about themselves in order to position the objects.

5. The machine as claimed in claim 4, further comprising a plurality of elastically deformable adjacent revolving rollers located immediately beneath the sorting path in order to soften the fall of the objects.

6. The machine as claimed in claim 1, further comprising a plurality of elastically deformable adjacent revolving rollers located immediately beneath the sorting path in order to soften the fall of the objects.

7. A method of sorting, by size, pear-shaped objects having the general shape of an oval with a more or less narrow end, the method comprising:

conveying the objects substantially horizontally on a conveyor having a first alignment of equidistant parallel primary rollers, which are separated each from the next by an interval that is sufficient to allow one of the objects to pass through, the conveyor also having a second alignment of secondary rollers each of which is arranged in alignment with one of the intervals between the primary rollers; and progressively moving the secondary rollers, relative to the primary rollers, in a direction that is perpendicular to a plane of travel of the primary rollers, wherein the secondary rollers are moved relative to the primary rollers by means for guiding the secondary rollers along a sorting path of the conveyor, the guide means being capable of progressively moving the secondary rollers away from the primary rollers along the length of the sorting path, wherein the primary and secondary rollers do not rotate about their axes for a greater part of the sorting path.

8. The method as claimed in claim 7, further comprising positioning the objects upstream of the sorting path so that the longitudinal axes of the objects are generally parallel to the longitudinal axes of the primary and secondary rollers.

9. The method as claimed in claim 8, wherein the objects are positioned by a positioning means that comprises an auxiliary feeder having rollers that are rotated slowly about themselves and means for transferring the objects from the auxiliary feeder to the conveyor with little or no modification of the orientation of the objects.

10. The method as claimed in claim 7, further comprising rotating the primary and secondary rollers along the length of an object receiving section of the conveyor to position the objects upstream of the sorting path, wherein the objects are positioned so that the longitudinal axes of the objects are generally parallel to the longitudinal axes of the primary and secondary rollers.

11. A machine for sorting, by size, pear-shaped objects, said machine comprising:

a conveyor having a first alignment of equidistantly spaced parallel primary rollers, wherein adjacent ones of said primary rollers are spaced by an interval that is sufficient to permit a single object to pass through, and a second alignment of secondary rollers, said secondary rollers being aligned with the intervals between said primary rollers, respectively, wherein said secondary rollers are capable of moving in a direction that is substantially perpendicular to the longitudinal axes of said primary rollers;

a device for moving said conveyor so that said primary and secondary rollers are moved along a sorting path;

a pair of guide ramps for guiding said secondary rollers along the sorting path, said guide ramps being operable to progressively move said secondary rollers away from said primary rollers as said primary and secondary rollers are moved along the length of the sorting path by said moving device, wherein said primary and secondary rollers do not rotate about their axes over a substantial portion of the sorting path; and an auxiliary object feeder positioned upstream of the sorting path, wherein said auxiliary object feeder is operable to orient the objects so that their longitudinal axes are essentially parallel to said primary and secondary rollers.

12. The machine as claimed in claim 11, further comprising a ramp positioned between said auxiliary object feeder and the sorting path.

13. The machine as claimed in claim 12, further comprising a presser roller disposed adjacent said ramp.

14. The machine as claimed in claim 11, further comprising a plurality of elastically deformable adjacent revolving rollers located immediately beneath the sorting path in order to soften the fall of the objects.

15. The machine as claimed in claim 11, further comprising a plurality of rotatable brushes located immediately beneath the sorting path.

16. The machine as claimed in claim 11, wherein said device for moving said conveyor comprises a pair of drums, and one of said drums is a drive drum.

* * * * *